United States Patent [19]

Adams, Jr.

[11] 4,082,983

[45] Apr. 4, 1978

[54] CAPACITOR CHARGING SYSTEM FOR ELECTRONIC FLASH APPARATUS

[75] Inventor: James R. Adams, Jr., Littleton, Colo.

[73] Assignee: Rollei of America, Inc., Littleton, Colo.

[21] Appl. No.: 748,785

[22] Filed: Dec. 9, 1976

Related U.S. Application Data

[63] Continuation of Ser. No. 589,220, Jun. 23, 1975, abandoned.

[51] Int. Cl.[2] ..... H05B 41/32

[52] U.S. Cl. ..... 315/241 P; 315/151; 320/1

[58] Field of Search ..... 320/1; 315/151, 156, 315/158, 159, 241 P; 354/145

[56] References Cited

U.S. PATENT DOCUMENTS

| | | | |
|---|---|---|---|
| 3,417,306 | 12/1968 | Knak | 320/1 |
| 3,644,818 | 2/1972 | Paget | 315/241 P X |
| 3,764,849 | 10/1973 | Ohta | 315/241 P |
| 3,777,212 | 12/1973 | Mashimo | 315/241 P |
| 3,882,358 | 5/1975 | Deskevich et al. | 320/1 |
| 3,896,333 | 7/1975 | Nakamura | 315/151 |
| 3,946,269 | 3/1976 | Ban | 315/241 P |
| 3,947,720 | 3/1976 | Breitkreuz | 315/241 P |

FOREIGN PATENT DOCUMENTS

| | | |
|---|---|---|
| 1,354,134 | 5/1974 | United Kingdom. |

*Primary Examiner*—Eugene R. LaRoche
*Attorney, Agent, or Firm*—Allegretti, Newitt, Witcoff & McAndrews

[57] ABSTRACT

Electronic flash apparatus includes a flash storage capacitor, a flash tube for selectively discharging the flash storage capacitor to produce light flashes, and terminating means for terminating the light flash. Separate charging means supplies charging current to the flash storage capacitor. Control means causes the charging means to supply the charging current to the flash storage capacitor each time the terminating means terminates a light flash.

20 Claims, 3 Drawing Figures

CAPACITOR CHARGING SYSTEM FOR ELECTRONIC FLASH APPARATUS

This is a continuation, of application Ser. No. 589,220, filed June 23, 1975, now abandoned.

BACKGROUND OF THE INVENTION

The present invention relates generally to improved electronic flash apparatus. In particular, the present invention is concerned with control systems for controlling the charging of the flash storage capacitor of electronic flash apparatus.

Electronic flash apparatus is known in the art in which a relatively high voltage is stored on a capacitor. At the instant of taking a picture, the capacitor is discharged through a gas filled flash tube to provide the desired light.

In electronic flash apparatus of this type, some form of charging apparatus or power supply must be provided to recharge the flash storage capacitor. One particularly advantageous charging apparatus is shown in U.S. Pat. No. 3,863,128 by Dennis J. Wilwerding, which is assigned to the same assignee as the present application. In this system, a battery powered DC to DC oscillator charges the flash storage capacitor of the electronic flash apparatus. Monitoring and controlling circuits are provided to maintain the voltage on the flash storage capacitor within desired limits.

Certain electronic flash apparatus include separate capacitor charging and flash units or modules. By separating the charging unit from the flash unit, it is possible to use the same charging unit to charge the flash storage capacitor in several different flash units. In addition, the flash unit can be lighter and more compact when the charging unit is separate.

Electronic flash apparatus having separate charging and flash units preferably has the flash storage capacitor in the flash unit rather than in the charging unit. This reduces the current carrying requirements for the wires connecting the charging unit to the flash unit. Very high currents are produced when the flash storage capacitor is discharged through the flash tube to produce a light flash.

One disadvantage of having the flash storage capacitor in the flash unit is that the charging unit cannot directly sense the voltage on the flash storage capacitor. The voltage on the flash storage capacitor cannot be directly sensed because a pair of diodes are connected between the charging unit and the flash storage capacitor to allow only unidirectional current flow from the charging unit to the flash storage capacitor. The diodes, which are connected between one terminal of the flash unit and the flash storage capacitor, prevent a discharge of the flash storage capacitor if the user accidently comes in contact with both terminals of the flash unit.

In this type of electronic flash apparatus, the separate charging unit contains an internal capacitor and resistor which will discharge with the time constant determined by the capacitance and resistance or will follow the voltage on the flash storage capacitor as the flash storage capacitor discharges to any voltage below that on the internal capacitor. When the voltage on the internal capacitor decreases to a predetermined value (generally about 200 volts) the oscillator turns on and charges the internal capacitor and the main storage capacitor to the desired maximum voltage (generally about 350 volts). The charging unit then turns off until the voltage on the internal capacitor has again reduced to the predetermined minimum value.

Although generally satisfactory, this system does allow the voltage on the flash storage capacitor to decrease significantly without recharging. For example, in automatic electronic flash apparatus of the series termination type, the light flash may be terminated before the flash storage capacitor has been fully discharged. Unless the voltage on the flash storage capacitor has decreased from its maximum desired value of about 350 volts to about 200 volts, it will not be recharged even though a light flash has been produced.

For example, a terminated flash may cause the voltage on the flash storage capacitor to drop by only about 20 volts. Although the voltage on the flash storage capacitor has dropped, it has not decreased enough to turn on the charging unit. The next light flash will be produced, therefore, with the voltage on the flash storage capacitor at a value which is less than the maximum desired voltage.

SUMMARY OF THE INVENTION

The electronic flash apparatus of the present invention includes first capacitor means, flash tube means for selectively discharging the first capacitor to produce light flashes, first capacitor charging means for supplying a charging current to the first capacitor means, and terminating means for terminating the light flash. Control means causes the first capacitor charging means to supply the charging current to the first capacitor means each time the terminating means terminates a light flash. The first capacitor means is, therefore, charged to its maximum desired value after each light flash.

In preferred embodiments of the present invention, the control means controls the first capacitor charging means as the function of a second charging current. The electronic flash apparatus includes second capacitor means which discharges during the light flash and which is recharged by the second charging current from the first capacitor means.

DETAILED DESCRIPTION OF THE PREFERRED EMBODIMENTS

Figure 1:
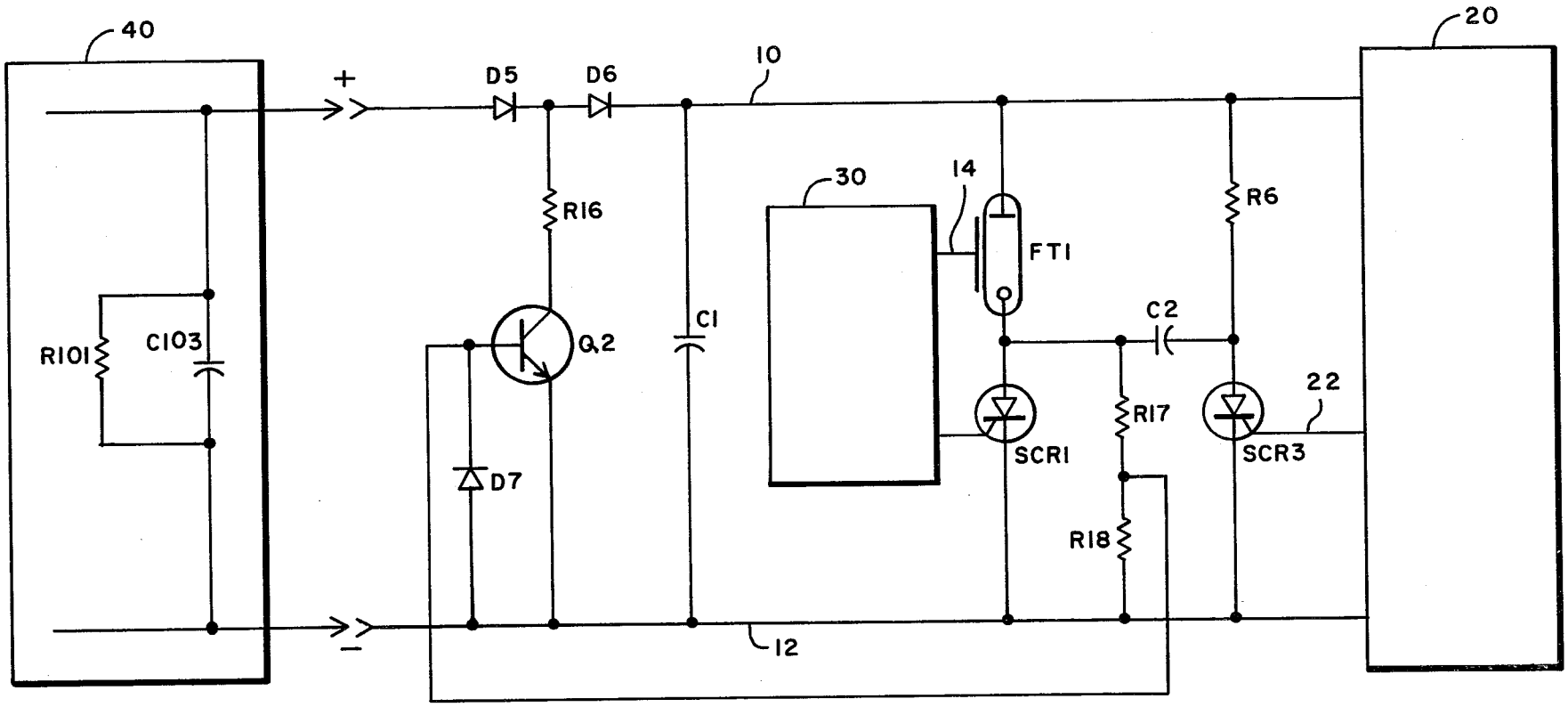
FIG. 1 schematically shows one embodiment of the present invention.

FIG. 1 shows one preferred embodiment of the present invention. The electronic flash apparatus of FIG. 1 includes conductors 10 and 12. Conductor 10 is connected to a positive terminal through diodes D5 and D6, and conductor 12 is connected to a negative terminal.

Main flash storage capacitor C1 is connected between conductors 10 and 12. Also connected between conductors 10 and 12 is the series connection of flash tube FT1 and flash termination switch SCR1. As shown in FIG. 1, flash termination switch SCR1 may be a semiconductor switching device such as a silicon controlled rectifier. SCR1 has two main current carrying electrodes (anode and cathode) and a control electrode (gate) which controls the conductivity between the anode and cathode. In FIG. 1, the anode of flash tube FT1 is connected to conductor 10. The cathode of flash tube FT1 is connected to the anode of SCR1, and the cathode of SCR1 is connected to conductor 12.

In order to initiate a light flash, an ignition signal must be applied to the triggering terminal 14 of flash tube FT1. In addition, SCR1 must be turned on at the same time by a signal to the gate of SCR1. These signals are produced by trigger circuit 30, which may take one of many well known forms.

Exposure control circuit 20, which may be one of many well known exposure control circuits used for automatic electronic flash apparatus, receives light reflected from the scene which is illuminated by the flash. When the total light received by exposure control circuit 20 exceeds a predetermined desired value, exposure control circuit 20 produces a flash termination signal at terminal 22.

FIG. 1 includes a circuit for turning off SCR1 and thus terminating the light flash in response to a flash termination signal at terminal 22. The termination circuit, which includes resistors R6, R17, and R18, commutation capacitor C2, and commutation switch SCR3, turns off SCR1 by the well known commutation technique.

Commutation switch SCR3 is, like SCR1, preferably a semiconductor switching device. SCR3 has two main current carrying electrodes (anode and cathode) and a control electrode (gate). The gate of SCR3 is connected to terminal 22 to receive the flash termination signal. The cathode of SCR3 is connected to conductor 12, and the anode of SCR3 is connected to one terminal of resistor R6. The other terminal of resistor R6 is connected to conductor 10. Commutation capacitor C2 is connected between the anodes of SCR1 and SCR3. Resistors R17 and R18 are connected between the anode and cathode of SCR1.

Flash storage capacitor charging circuit 40 charges flash storage capacitor C1. Flash storage capacitor charging circuit 40 is generally a separate unit from the flash unit and is connected to the flash unit by an appropriate electrical cord. Because of blocking diodes D5 and D6, the internal controlling circuitry of charging circuit 40 cannot directly sense the voltage on flash storage capacitor C1. Instead, charging circuit 40 includes an internal capacitor C103 and internal resistor R101. The voltage monitoring and controlling circuitry of charging circuit 40 monitors the voltage on internal capacitor C103 and charges C103 to a predetermined desired maximum value when the voltage on C103 decreases to a predetermined minimum value. The voltage on C1 follows that of C103 less the voltage drops across diodes D5 and D6.

The present invention provides a control circuit for causing the charging circuit 40 to charge flash storage capacitor C1 each time a light flash has occurred, even though the voltage on C1 has not decreased to a value which would otherwise cause charging circuit 40 to begin charging capacitor C1. The control circuit includes resistors R16, R17, and R18, transistor Q2, and diode D7. As shown in FIG. 1, the base of transistor Q2 is connected to the junction of resistors R17 and R18. The emitter of Q2 is connected to conductor 12, and the collector of Q2 is connected through resistor R16 to the junction of diodes D5 and D6. Diode D7 is connected between the base and emitter of Q2 so that D7 is reverse biased when Q2 base - emitter is forward biased.

The operation of the apparatus shown in FIG. 1 is generally as follows. Charging circuit 40 charges flash storage capacitor C1 to a relatively high voltage (generally about 350 volts). Capacitor C1 provides a source of energy to the electronic flash apparatus during the production of the light flash.

When capacitor C1 is charged, capacitor C2 is also charged through resistors R6, R17, and R18.

To initiate a flash, the user closes contacts (not shown) which form a part of triggering circuit 30. Triggering circuit 30 produces signals at triggering terminal 14 of flash tube FT1 and at the gate of SCR1. These triggering signals cause both FT1 and SCR1 to turn on, and FT1 begins to produce the light flash.

Once FT1 and SCR1 have been triggered on and light is being produced by FT1, exposure control circuit 20 begins to sense the light reflected from the object being illuminated. When the total light received by exposure control circuit 20 exceeds a predetermined desired value, a flash termination signal is produced at terminal 22. This flash termination signal is applied to the gate of SCR3, thereby turning SCR3 on.

When commutation switch SCR3 is turned on, the voltage at the anode of SCR1 is reduced. This reduction in voltage at the anode of SCR1 turns off SCR1, thereby terminating the light flash.

When the light flash has been terminated by this commutation technique, C2 has discharged and must be recharged from C1 through the charging circuit formed by R6, R17, R18, and C1. The charging current flowing through resistor R18 causes the base - emitter junction of transistor Q2 to be forward biased. Transistor Q2 saturates, thereby placing resistor R16 across internal capacitor C103 (but not across capacitor C1 because of diode D6). When Q2 turns on, therefore, C103 is discharged through diode D5 and resistor R16 at a rate which is essentially determined by the capacitance of C103 and the resistance of R16. This time constant is chosen such that C103 discharges to the minimum voltage (generally about 200 volts) in about one-half second. This causes the dropping circuit 40 to restart and recharge flash storage capacitor C1 to full voltage.

The present invention, therefore, overcomes the difficulties encountered with prior remote capacitor charging units. The flash storage capacitor C1 is charged to full voltage after each light flash. The control circuit of the present invention causes charging circuit 40 to supply charging current to capacitor C1 each time the light flash is terminated by commutation. For those light flashes which the proper light level is never received, the light flash will continue until capacitor C1 has been discharged to a point where it can no longer support conduction through flash tube FT1 and SCR1. In this case, the voltage on C1 has dropped low enough that the voltage on capacitor C103 has dropped below the predetermined minimum value, and charging circuit 40 begins to charge capacitor C1. In either case, capacitor C1 is charged to its maximum voltage after each light flash.

Although the electronic flash apparatus shown in FIG. 1 uses the charging current to commutation capacitor C2 to control charging circuit 40, the current or voltage to another circuit element within the flash apparatus could also be used. The requirements for the circuit element are that a current or voltage be supplied to it during or immediately after the light flash.

Figure 2:
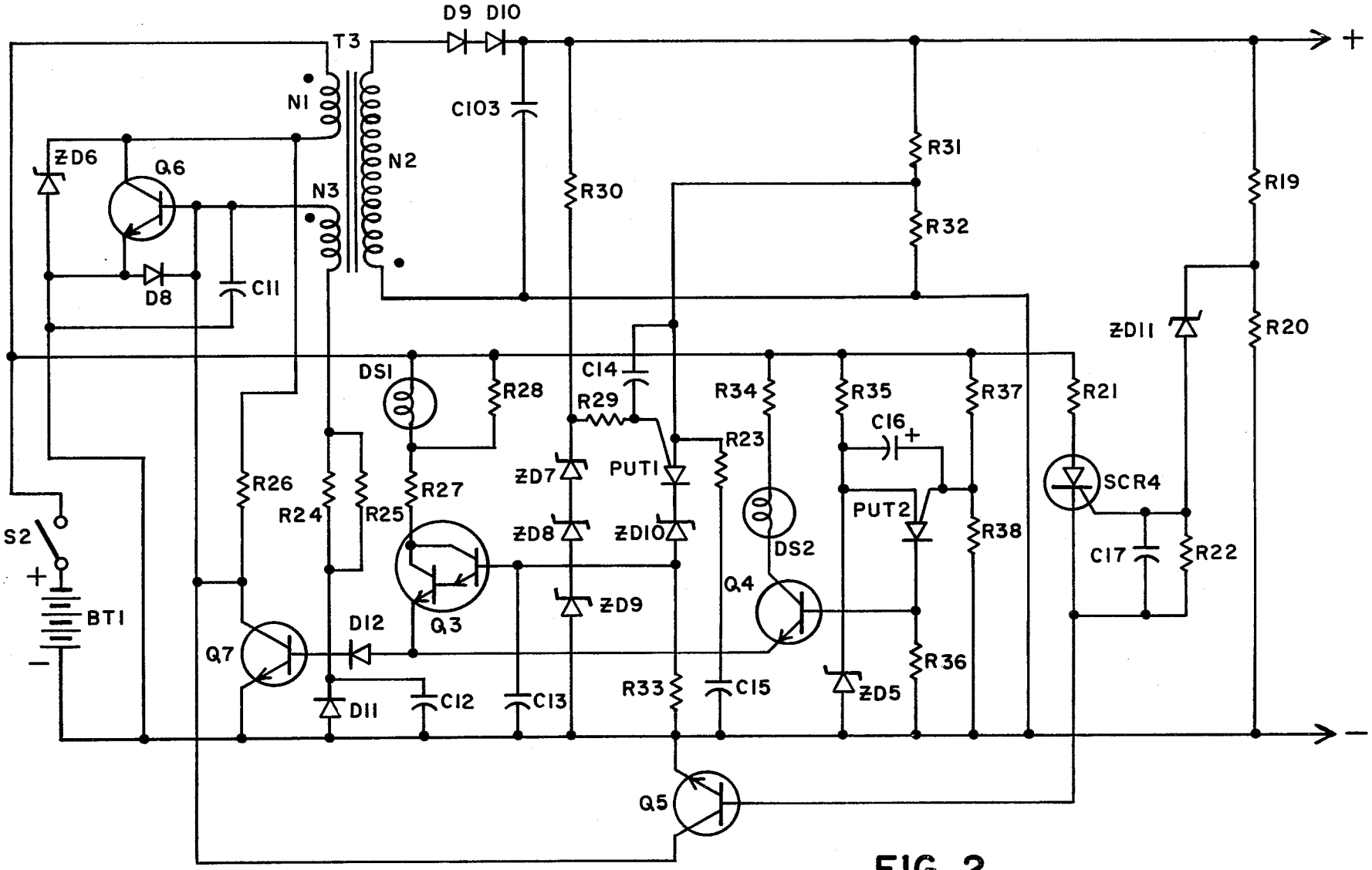
FIG. 2 schematically shows capacitor charging means which may be used in conjunction with the present invention.

FIG. 2 shows one capacitor charging circuit which may be used with the present invention. The circuit shown in FIG. 2 is generally similar to the circuits shown in U.S. Pat. No. 3,863,128 by Dennis J. Wilwerding. The circuit is basically a battery powered DC to DC converter oscillator with voltage monitoring, controlling and protecting apparatus.

FIG. 2 includes an internal capacitor C103 which is charged by the DC to DC converter oscillator. The internal resistor R101 shown in FIG. 1 is the effective resistance of a number of resistors which are connected in parallel. Among these resistors are R31, R32, R19, and R20. Capacitor C103 discharges with a time constant determined by the capacitance of C103 and the effective internal resistance (determined by the various resistors connected in parallel with C103) or will follow the voltage on C1 as C1 discharges to any voltage below that of C103.

The oscillator is formed by battery BT1, switch S2, transformer T3, which has windings N1, N2, and N3, transistor Q6, zerer diode ZD6, diodes D8, D9, D10, and D11, capacitors C11 and C12, and resistors R24, R25, and R26. This oscillator circuit transfers electrical energy from battery BT1 to internal capacitor C103 when it is in operation.

The charging circuit shown in FIG. 2 includes three voltage monitoring, controlling, and protecting circuits. The first circuit monitors the voltage on capacitor C103 and starts and stops the battery powered DC to DC converter oscillator as necessary to maintain the voltage on capacitor C103 within desired limits. The first monitoring and controlling circuitry includes zener diodes ZD7, ZD8, ZD9, and ZD10, resistors R23, R27, R28, R29, R30, R31, R32, and R33, capacitors C13, C14, and C15, transistors Q3 and Q7, diode D12, indicator lamp DS1, and programmable unijunction transistor PUT1.

The first monitoring and controlling circuitry operates in the manner described in the Wilwerding U.S. Pat. No. 3,863,128. PUT1 monitors the voltage on capacitor C103 by continuously comparing the PUT1 anode voltage, which is representative of the voltage on C103, to the fixed reference voltage which zener diodes ZD7, ZD8, and ZD9 cause to appear at the gate of PUT1. PUT1 remains off until the voltage on C103 has been raised to the desired maximum value (generally about 350 volts).

When the voltage on C103 reaches the desired maximum value, the anode voltage of PUT1 exceeds the gate voltage and PUT1 turns on and latches in this condition. This causes current to flow through R31, PUT1 anode to cathode, ZD10, the base - emitter path of Darlington transistor Q3, diode D12, and the base - emitter path of transistor Q7. When Q3 turns on, indicator lamp DS1 is illuminated. When Q7 turns on, it effectively short circuits base drive to oscillator transistor Q6, thereby stopping the oscillator.

PUT1 continues to monitor the voltage on capacitor C103 and remains on (and the oscillator remains off) until the capacitor voltage drops sufficiently to reduce the PUT1 anode voltage to the turn off value. This value is determined by the zener voltage of ZD10 as well as the rating of PUT1. The particular turn off voltage is selected to be the predetermined minimum value of the voltage on C103 (generally about 200 volts). When the voltage on C103 decreases to the predetermined minimum value, PUT1 turns off. As a result, transistors Q3 and Q7 turn off and the oscillator restarts.

The second voltage monitoring and controlling circuit provides redundant maximum voltage protection in the event that the first monitoring and controlling circuit is somehow rendered inoperative. This second monitoring and controlling circuit includes zener diode ZD11, resistors R19, R20, R21, and R22, capacitor C17, semiconductor switch SCR4, and transistor Q5.

In the event that the first monitoring and controlling circuit is not effective in controlling the maximum voltage on capacitor C103 and the voltage continues to rise beyond the predetermined maximum voltage, SCR4 turns on. This causes transistor Q5 to turn on, thereby effectively short circuiting base drive to oscillator transistor Q6 and turning off the oscillator. Once SCR4 has turned on, it will not turn off even if the voltage on capacitor C103 is reduced. The anode of SCR4 is connected, through resistor R21, and one terminal of switch S2 to the positive terminal off battery BT1. Resistor R21 is chosen such that when SCR4 turns on, the current provided from the battery BT1 through R21 is greater than the holding current of SCR4. Once SCR4 turns on, therefore, it will only turn off if switch S2 is opened. The second monitoring controlling circuit, therefore, provides additional protection against run away oscillator operation.

The third monitoring and controlling circuit protects the battery voltage from being reduced beyond the predetermined minimum value. This third circuit is similar to the circuit shown in the previously mentioned Wilwerding patent.

The third monitoring and controlling circuit includes resistors R34, R35, R36, R37, and R38, zener diode ZD5, capacitor C16, indicator lamp DS2, programmable unijunction transistor PUT2, diode D12, and transistors Q4 and Q7. PUT2 monitors the battery voltage by continuously comparing the PUT2 gate voltage, which is representative of the battery voltage, to the fixed reference voltage which zener diode ZD5 causes to appear at the anode of PUT2. PUT2 remains off until the battery voltage drops below the predetermined minimum value.

When PUT2 turns on, it causes current to flow through R35, PUT2 anode-to-cathode, Q4 base-to-emitter, through diode D12, and through Q7 base-to-emitter. This turns transistors Q4 and Q7 on. When transistor Q4 turns on, indicator lamp DS2 is illuminated. When transistor Q7 turns on, it effectively short circuits base drive to oscillator transistor Q6, thereby turning the oscillator off to prevent further discharge of battery BT1 by the oscillator. This condition continues until switch S2 is opened and battery BT1 is disconnected from the circuit.

From FIG. 2, it can be seen that the charging circuit of FIG. 2 is controlled by the voltage on internal capacitor C103. Since the predetermined maximum voltage on C103 is about 350 volts and the predetermined minimum value is about 200 volts, the voltage on flash storage capacitor C1 can vary significantly without causing the charging circuit to recharge C1. The control circuit of the present invention, however, overcomes this difficulty by reducing the voltage on capacitor C103 until the oscillator turns on. This reduction of voltage of capacitor C103 is caused by the control circuit of the present invention each time a light flash is terminated.

Figure 3:
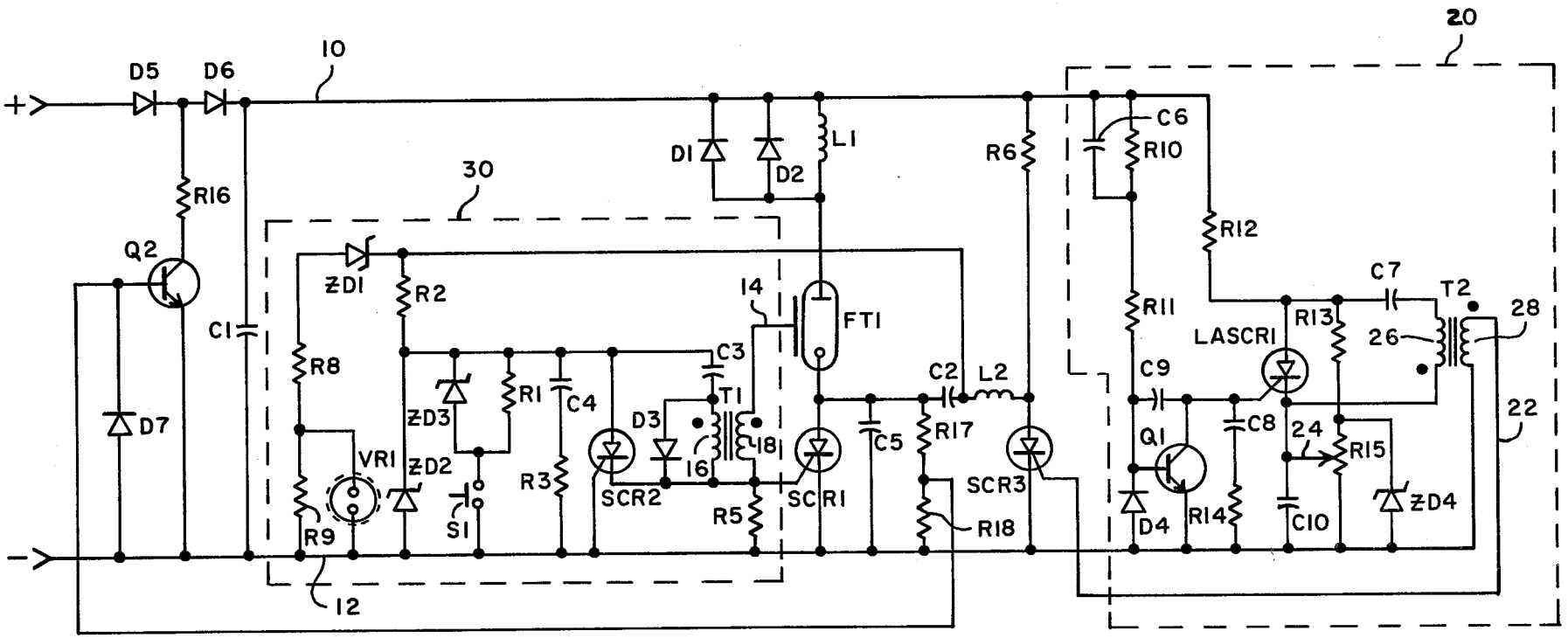
FIG. 3 schematically shows another embodiment of the electronic flash apparatus of the present invention.

FIG. 3 shows another preferred embodiment of the electronic flash unit of the present invention. This embodiment is generally similar to that shown in FIG. 1, and similar letters and numerals are used to designate similar elements.

Conductor 10 is connected to a positive terminal through blocking diodes D5 and D6. Conductor 12 is connected to a negative terminal. A capacitor charging circuit such as the circuit shown in FIG. 2 is connected to the positive and negative terminals.

Main flash storage capacitor C1 is connected between conductors 10 and 12. Also connected between conductors 10 and 12 is the series connection of inductor L1, flash tube FT1, and flash termination switch SCR1. SCR1 has two main current carrying electrodes (anode and cathode) and a control electrode (gate) which controls the conductivity between the anode and cathode.

One terminal of L1 is connected to conductor 10, and the other terminal is connected to the anode of flash tube FT1. The cathode of flash tube FT1 is connected to the anode of SCR1, and the cathode of SCR1 is connected to conductor 12.

The purpose of L1 is to reduce the peak current flowing into SCR1. Diodes D1 and D2, which ae connected in parallel with inductor L1, are "free wheeling" diodes which prevent a large negative voltage from being induced in L1 when SCR1 is turned off.

In order to initiate a light flash, an ignition signal must be applied to the triggering terminal 14 of flash tube FT1. In addition, SCR1 must be turned on at the same time by a signal to the gate of SCR1. These signals are produced by triggering circuit 30, which includes resistors R1, R2, R3, and R5, capacitors C3 and C4, contacts S1, zener diodes ZD2 and ZD3, diode D3, transformer T1, and flash trigger switch SCR2.

Resistors R2 and Zener diode ZD2 are connected in series to form a voltage divider network. Connected to the junction between resistor R2 and zener diode ZD2 is one terminal of resistor R1. The other terminal of resistor R1 is connected to one terminal of contacts S1. The second terminal of contacts S1 is connected to conductor 12, so that R1 and S1 are connected in parallel with ZD2.

Zener diode ZD3 is connected in parallel with resistor R1. The zener voltage of ZD3 is less than the zener voltage of ZD2. In one preferred embodiment, the zener voltage of ZD2 is about 170 volts, and the zener voltage of ZD3 is about 100 volts.

R1 forms a noise inhibiting means preventing the false triggering of SCR2, SCR1 and FT1 from noise injected at S1. R1 has a high resistance; in one embodiment R1 is about 5 megohm.

ZD3 forms gating means which eliminate false triggering due to contact bounce by disenabling contacts S1 from triggering SCR1 and SCR2 unless a voltage at a selected point in the circuit has attained a predetermined value.

Flash trigger switch SCR2 is, like SCR1, preferably a semiconductor switching device such as a silicon controlled rectifier. SCR2 has first and second main current carrying electrodes (anode and cathode) and a control electrode (gate). The anode of SCR2 is connected to the junction of resistor R2 and zener diode ZD2, and the cathode of SCR2 is connected to the gate of SCR1. The gate of SCR2 is connected to conductor 12.

Resistor R5 is connected between the gate of SCR1 and conductor 12. The resistance of resistor R5 is selected to swamp out gate-cathode noise transients which could cause false triggering of SCR1 and SCR2.

Also connected in parallel with ZD2 is a series RC network formed by resistor R3 and capacitor C4. One terminal of resistor R3 is connected to the anode of SCR2. The other terminal of resistor R3 is connected to one terminal of capacitor C4. The other terminal of capacitor C4 is connected to conductor 12.

Transformer T1 has primary and secondary windings 16 and 18, respectively. One terminal of secondary winding 18 is connected to the flash trigger electrode 14 of flash tube FT1. The other terminal is connected to the terminal of primary winding 16 and to the cathode of SCR2. The other terminal of primary winding 16 and to the cathode of SCR2. The other teminal of primary winding 16 is connected to capacitor C3. The opposite terminal of capacitor C3 is connected to the anode of SCR2. Capacitor C3 and primary winding 16, therefore, are connected in parallel with the anode-to-cathode current path of SCR2. Diode D3 is connected in parallel with primary winding 16.

Exposure control circuit 20, which may be one of many well known exposure control circuits used for automatic electronic flash apparatus, receives light reflected from the scene which is illuminated by the flash. When the total light received by exposure control circuit 20 exceeds a predetermined desired value, exposure control circuit 20 produces a flash termination signal at terminal 22.

The particular exposure control circuit 20 shown in FIG. 3 is similar to the circuits described in U.S. Pat. No. 3,519,879 by F.T. Ogawa. It is understood however, that exposure control circuit 20 may take many other forms.

A series circuit consisting of resistors R10, R11, and diode D4 is connected between conductors 10 and 12. Capacitor C6 is connected between conductor 10 and the junction of resistors R10 and R11. Capacitor C6, therefore, is connected in parallel with resistor R10.

The light sensing element of exposure control circuit 20 is a light activated silicon controlled rectifier, LASCR1. The anode of LASCR1 is connected to conductor 10 through resistor 12. The cathode of LASCR1 is connected to conductor 12 through capacitor C10. Integrating capacitor C8 and anticipation resistor R14 are connected between the gate of LASCR1 and conductor 12.

A series connection is formed between connectors 10 and 12 by resistors R12, R13, and R15. Resistor R13 is connected between the anode of LASCR1 and one terminal of resistor R15. The other terminal of resistor R15 is connected to conductor 12. Resistor R15 also has a sliding contact 24 which is connected to the cathode of LASCR1. The voltage on capacitor C10 and the cathode of LASCR1 is, therefore, determined by the position of sliding contact 24. Zener diode ZD4 is connected in parallel with resistor R15 to limit the voltage on resistor R15.

Transformer T2 has primary and secondary windings 26 and 28, respectively. One terminal of primary winding 26 is conntected to the cathode of LASCR1, and the other terminal is connected to one terminal of capacitor C7. The other terminal of capacitor C7 is connected to the anode of LASCR1, thereby forming a series circuit including capacitor C7, primary winding 26, and anode - cathode of LASCR1.

one terminal of secondary winding 28 is connected to conductor 12. The other terminal 22 is connected to the gate of commutation swith SCR3. Terminal 22 applies the flash termination signal to the gate of SCR3.

Transistor Q1 normally disables circuit 20 and enables the circuit only upon the firing of FT1. Transistor Q1 has its collector electrode connected to the gate of LASCR1 and its emitter electrode connected to conductor 12. The collector - emitter current path of transistor Q1, therefore, is connected in parallel with integrating capacitor C8 and anticipation resistor R14. The base electrode of transistor Q1 is connected to the junction between resistor R11 and diode D4. Diode D4 is connected to be reverse biased when the base - emitter junction of transistor Q1 is forward biased. Finally, capacitor C9 is connected between the base and collector electrodes of transistor Q1.

FIG. 3 includes a circuit for turning off SCR1 and thus terminating the light flash in response to a flash termination signal at terminal 22. The termination circuit, which includes resistors R6, R17, and R18, commutation capacitor C2, inductor L2, capacitor C5, and commutation switch SCR3, turns off SCR1 by the well known commutation technique.

The gate to SCR3 is connected to terminal 22 to receive the flash termination signal. The cathode of SCR3 is connected to conductor 12, and the anode of SCR3 is connected to one terminal of resistor R6. The other terminal of resistor R6 is connected to conductor 10. Commutation capacitor C2 and inductor L2 are connected in series between the anodes of SCR1 and SCR3. Resistors R17 and R18, and capacitor C5, are connected between the anode and cathode of SCR1.

Resistor R2 is connected to the junction of inductor L2 and commutation capacitor C2. The charging of capacitors C3 and C4, therefore, is dependent upon the charging of capacitor C2. Since zener diode ZD2 is connected in parallel with RC network R3 - C4 and also with contacts S1 and resistor R1, ZD2 limits the voltage on capacitors C3 and C4 to a value which is less than the full voltage on commutation capacitor C2.

An indicator circuit including zener diode ZD1, resistors R8 and R9, and neon indicator lamp VR1 is connected to sense the voltage on commutation capacitor C2. One terminal of zener diode ZD1 is connected to the junction of inductor L2 and commutation capacitor C2. The other terminal of zener diode Zd1 is connected to a voltage divider circuit formed by resistors R8 and R9. One terminal of resistor R9 is connected to conductor 12.

indicator VR1, which is connected in parallel with resistor R9, only emits light when a predetermined voltage is on commutation capacitor C2. This predetermined voltage is determined by the zener voltage of ZD1 and the values of resistors R8 and R9. The predetermined voltage has been selected so that commutation capacitor C2, as well as capacitors C3 and C4 have the necessary voltage to produce proper operation of the circuit. Indicator VR1 goes out at the initiation of commutation, and does not turn back on and emit light until both main capacitor C1 and commutation capacitor C2 are charged to the predetermined voltage.

A control circuit controls the capacitor charging circuit for charging capacitor C1. This control circuit includes resistors R16, R17, and R18, transistor Q2, and diode D7. The base of transistor Q2 is connected to the junction of resistors R17 and R18. The collector of Q2 is connected through R16 to the junction of diodes D5 and D6. The emitter of Q2 is connected to conductor 12. Diode D7 is connected between the base emitter junction of transistor Q2 so that diode D7 is reverse biased when the base emitter junction of Q2 is forward biased.

The operation of the circuit shown in FIG. 3 is generally as follows. Initially, main storage capacitor C1 is charged to a relatively high voltage (generally about 350 to 360 volts) by a capacitor charging circuit similar to that of FIG. 2. Commutation capacitor C2 has a much lower value than flash storage capacitor C1, and thus charges to the voltage on C1 through the charging circuit formed by resistors R6, R17, and R18, and inductor L2. With voltage on commutation capacitor C2, capacitor C4 charges via resistors R6, R2, and R3 to a voltage limited by zener diode ZD2. Similarly, capacitor C3 charges via resistors R6 and R2, primary winding 16, and resistor R5 to the same voltage as capacitor C4.

Voltage indicator VR1 senses the voltage level on commutation capacitor C2 and turns on when the voltage divider formed by ZD1, R8, and R9 senses that the voltage level of C2 has exceeded a predetermined value. In one preferred embodiment, this predetermined value is about 300 volts. Indicator VR1 turns on and emits light, thereby indicating that the apparatus is ready for operation.

At this time, transistor Q1 is turned on, thereby causing the collector - emitter current path to effectively short circuit capacitor C8 and resistor R14. LASCR1, therefore, is held in an "off" or non-conductive state. As a result, sensing circuit 20 is disabled so that commutation switch SCR3 is not prematurely actuated by extraneous causes.

To initiate a flash, contacts S1 are closed. Current flows out of capacitor C3, through zener diode ZD3, through contacts S1, from gate to cathode of SCR2 and through primary winding 16 to capacitor C3. The time required to turn on SCR2 is rather short (typically about 1 microsecond) and, therefore, C3 does not dissipate much energy until SCR2 turns on. At that time, C3 dumps its charge through SCR2 anode-to-cathode and into primary winding 16. The voltage induced in secondary winding 18 is applied to triggering electrode 14 of FT1 to turn FT1 on.

With SCR2 on, a discharge path is established for charge stored on capacitor C4. It discharges through a current path including SCR2 anode-to-cathode, SCR1 gate-to-cathode, and resistor R3. The discharge of capacitor C4 into the gate of SCR1 turns SCR1 on. The time constant of C4 and R3 is selected so that the gate current is maintained on SCR1 until sufficient current is available through flash tube FT1 to keep SCR1 in conduction.

The reduction in voltage between conductors 10 and 12 caused by the conduction of FT1 and SCR1 causes transistor Q1 to turn off. This enables light sensing circuit 20.

LASCR1 starts to receive light from the scene as a result of the operation of flash tube FT1. LASCR1 produces photocurrent which is proportional to the intensity of the incident light. This photocurrent flows through integrating capacitor C8 and resistor R14 and begins to charge capacitor C8.

As light continues to be received by LASCR1, the voltage on the gate of LASCR1 increases. When the gate trigger voltage of LASCR1 is exceeded, LASCR1 is switched into conduction. Capacitor C7 dumps its charge through the anodecathode current path of LASCR1 and into primary winding 26 of transformer T2. This produces a current pulse in secondary winding 28 which is applied through terminal 22 to the gate of commutation switch SCR3.

When commutation switch SCR3 is turned on, commutation capacitor C2 is charged in an opposite direction by C1 through L1, FT1, L2, and anode-to-cathode of SCR3. This causes a reduction in voltage at the anode of SCR1 and turns off SCR1, thereby terminating the flash.

When the light flash has been terminated by commutation, capacitor C2 is again charged in the original direction by the charging circuit including C1, R6, L2, R17, and R18. The commutation capacitor charging current flowing through resistor R18 causes the base-emitter junction of transistor Q2 to be forward biased. Transistor Q2 turns on, thereby placing resistor R16 across internal capacitor C103 of the capacitor charging circuit of FIG. 2. C103 discharges through diode D5, R16, and collector-to-emitter of Q2 at a rate which is essentially determined by the capacitance of C103 and the resistance of R16. This time constant is selected so that C103 discharges to the predetermined minimum value (about 200 volts) in about one-half second. When the predetermined minimum value is attained, PUT1 of FIG. 2 turns off, thereby restarting the battery powered DC to DC converter oscillator, which charges internal capacitor C103 and flash storage capacitor C1 back to the predetermined maximum voltage (about 350 to 360 volts).

The control circuit of the present invention controls the charging circuit for charging capacitor C1 as a function of a second charging current which flows from flash storage capacitor C1 to commutation capacitor C2. Since this second charging current flows after each light flash which has been terminated by commutation, capacitor C1 is recharged to full voltage after every terminated light flash.

The present invention restarts the capacitor charging circuit after each terminated light flash without having to reduce the voltage on both C1 and C103. Only the voltage on C103 is reduced by the control circuit, thereby saving the energy which is still stored in C1 at termination of the flash.

In conclusion, the present invention provides efficient control of the capacitor charging circuit so that the flash storage capacitor of an electronic flash unit will be recharged to full voltage after each light flash. This allows more consistent operation of the electronic flash apparatus, since the operating voltages will remain relatively constant from one flash to another. The present invention achieves this control with very few components.

Although the present invention has been described with reference to a series of preferred embodiments, workers skilled in the art will recognize that changes may be made in form or detail without departing from the spirit and scope of the invention.

The embodiments of the invention in which an exclusive property or right is claimed are defined as follows:

1. Electronic flash apparatus comprising:
flash tube means for producing a light flash;
first capacitor means for providing electrical current to the flash tube means;
second capacitor means for discharging during the light flash, the second capacitor means being recharged from the first capacitor means subsequent to the termination of the light flash;
first capacitor charging means for charging the first capacitor means; and
control means for sensing when the second capacitor means is being recharged and causing the first capacitor charging means to begin charging the first capacitor means.

2. The electronic flash apparatus of claim 1 wherein the first capacitor charging means includes third capacitor means and wherein the first capacitor charging means charges the first capacitor means when the voltage across the third capacitor means decreases to a predetermined minimum value.

3. The electronic flash apparatus of claim 2 wherein the control means discharges the third capacitor means to reduce the voltage across the third capacitor means to the predetermined minimum value.

4. The electronic flash apparatus of claim 3 and further comprising first and second diodes connected between the first capacitor charging means and the first capacitor means for allowing unidirection current flow from the first capacitor charging means to the first capacitor means.

5. The electronic flash apparatus of claim 4 wherein the control means is connected to discharge the third capacitor means through the first diode.

6. Electronic flash apparatus comprising:
first and second terminals;
flash tube means for providing a light flash;
first capacitor means connected to the first and second terminals, the first capacitor means providing electrical current to the flash tube means;
flash terminating means for terminating the light flash, the terminating means including second capacitor means which is discharged during termination of the light flash;
first capacitor charging means connected to the first and second terminals for charging the first capacitor means;
second capacitor charging means for charging the second capacitor means means; and
control means for sensing when the second capacitor means is being charged and for causing the first capacitor charging means to begin charging the first capacitor means when the second capacitor means is being charged.

7. The electronic flash apparatus of claim 6 wherein the terminating means further includes switching means connected in series with the flash tube means and the first capacitor means and wherein the second capacitor means applies a reverse voltage to the switching means to open the switching means and terminate the light flash.

8. The electronic flash apparatus of claim 6 further comprising first and second diodes connected between the first terminal and the first capacitor means for allowing unidirectional current flow from the first capacitor charging means to the first capacitor means.

9. The electronic flash apparatus of claim 8 wherein the first capacitor charging means includes third capacitor means and wherein the first capacitor charging means charges the first capacitor means when the voltage on the third capacitor means is reduced to a predetermined value.

10. The electronic flash apparatus of claim 9 wherein the control means discharges the third capacitor means to reduce the voltage on the third capacitor means to the predetermined value when the second capacitor means is being charged.

11. The electronic flash apparatus of claim 10 wherein the control means is connected to the second terminal and to a point between the first and second diodes.

12. The electronic flash apparatus of claim 11 wherein the control means discharges the third capacitor means through a current path from the first terminal, through the first diode, through the control means, and to the second terminal means.

13. The electronic flash apparatus of claim 12 wherein the control means comprises transistor means having base, emitter, and collector electrodes, the collector and emitter electrodes forming a current path from the first terminal through the first diode to the second terminal, and the base electrode being connected to sense charging current to the second capacitor means and controlling the flow of current between the collector and emitter electrodes as a function of the charging current.

14. In electronic flash apparatus including first capacitor means, flash tube means for selectively discharging the first capacitor means to provide flashes of light, second capacitor means for discharging during the flashes of light, first capacitor charging means for supplying first charging current to the first capacitor means, and second capacitor charging means for supplying second charging current from the first capacitor means to the second capacitor means, the improvement comprising:

control means for controlling the first capacitor charging means as a function of the second charging current.

15. The invention of claim 14 wherein the control means causes the first capacitor charging means to commence producing the first charging current when the second capacitor means receives the second charging current.

16. The invention of claim 14 wherein the first capacitor charging means comprises a DC to DC converter oscillator powered by a battery.

17. Electronic flash apparatus comprising:

first capacitor means;

flash tube means for selectively discharging the first capacitor means to produce light flashes;

first capacitor charging means for supplying first charging current to the first capacitor means;

terminating means for terminating the light flash, the terminating means including switching means connected in series with the flash tube means and the first capacitor means; and control means for causing first capacitor charging means to supply first charging current to the first capacitor means each time the terminating means terminates a light flash regardless of the amount the first capacitor discharged during the light flash.

18. Electronic flash apparatus comprising:

first capacitor means;

flash tube means for selectively discharging the first capacitor means to produce light flashes;

first capacitor charging means for charging the first capacitor means;

terminating means for terminating the light flash, the terminating means including flash termination switch means connected in series with the flash tube means for switching from a conductive to a non-conductive state to terminate the light flash; and control means for sensing a signal associated with the termination of a light flash and for causing the first capacitor charging means to commence charging the first capacitor means.

19. The electronic flash apparatus of claim 18 wherein the control means senses a current supplied to a circuit element during or immediately after a light flash.

20. The electronic flash apparatus of claim 18 wherein the control means senses a voltage supplied to a circuit element during or immediately after a light flash.

* * * * *